US005564703A

United States Patent [19]

McGuire

[11] Patent Number: 5,564,703

[45] Date of Patent: Oct. 15, 1996

[54] BLOCK AND PIN PUZZLE TOY

[76] Inventor: Mark A. McGuire, 646 Eagle Dr., Coppell, Tex. 75019

[21] Appl. No.: 546,691

[22] Filed: Oct. 23, 1995

[51] Int. Cl.[6] ..... A63F 9/12

[52] U.S. Cl. ..... 273/160; 273/153 S

[58] Field of Search ..... 273/153 R, 155, 273/156, 160; 70/289, 287, 288, 360, 361

[56] References Cited

U.S. PATENT DOCUMENTS

| | | | |
|---|---|---|---|
| 4,206,923 | 6/1980 | Cloutier | 273/160 |
| 4,283,055 | 8/1981 | Larsen | 273/160 |
| 4,397,466 | 8/1983 | Nichols | 273/156 |
| 4,471,959 | 9/1984 | Rubik | 273/153 S |
| 4,782,676 | 11/1988 | Friedman | 70/289 |
| 4,811,948 | 3/1989 | Gutierrez | 273/160 |
| 5,035,430 | 7/1991 | Suzuki | 273/153 S |
| 5,125,661 | 6/1992 | Jarboe | 273/156 |

*Primary Examiner*—Steven B. Wong
*Attorney, Agent, or Firm*—John E. Vandigriff

[57] ABSTRACT

The invention is to a puzzle toy which includes a solid body having a plurality of bore holes extending completely through the solid body such that each bore hole extends between two faces of the solid body. Some of the bore holes intersect with other bore holes such that pins inserted into the bore holes would interfere with at least one other pin in a bore hole. Some of the pins have at least one notch along its length to allow an interfering pin to partially pass through without interference. Each pin extends through a slide that moves the pin to one side after it is removed from its respective hole.

17 Claims, 6 Drawing Sheets

BLOCK AND PIN PUZZLE TOY

FIELD OF THE INVENTION

The invention relates to puzzle toys, and more particularly to a block and a plurality of interlocking pins that are inserted into the block in a predetermined order.

BACKGROUND OF THE INVENTION

Puzzle toys are common and have been made in various shapes, sizes and configurations. Several patents have been issued for puzzle toys that included a geometrical shape such as a cube or hexahedral solid body with a plurality of holes bored completely through the block from each of the surfaces of the body. Notched pins are inserted into the body such that notches in the pins allow other pins to be inserted through the body.

U.S. Pat. No. 4,206,923, issued Jun. 10, 1980, shows a block puzzle in which a plurality of pins are inserted into the block. The pins have notches of various depths and diameters to accommodate the passing of a pin at least partially through another pin.

U.S. Pat. No. 4,283,055, issued Aug. 11, 1981, shows a puzzle type toy in which a solid body has a plurality of bores of uniform depth extending into the solid body. A plurality of uniform length rods, having notches, are inserted into the bores of the solid body in a predetermined order such that some rods pass through the notches in other rods.

In the above two patents the rods or pins when inserted fully into the solid body makes it difficult for pulling a pin out of the solid body. Also once pulled out of the solid body, the pin or rod can become separated and/or lost thereby presenting an incomplete puzzle.

SUMMARY OF THE INVENTION

The invention is to a puzzle toy which includes a solid body having a plurality of bore holes extending completely through the solid body such that each bore hole extends between two faces of the solid body. Some of the bore holes intersect with other bore holes such that a pin inserted into the bore holes would interfere with at least one other pin in a bore hole.

Some of the pins have at least one notch along its length to allow an interfering pin to partially pass through without interference. When the pins are inserted in their respective bore holes in a predetermined order, each pin is fully insertable into the solid body. As each pin is pulled out of the body, it moves through a slide that is movable in the face of the solid body. As the end of the pin clears the bore hole, the slide will be moved laterally to the surface of the solid body, moving the pin to one side of the hole. The slide retains the end of the pin in the slide preventing it from being removed from the block.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
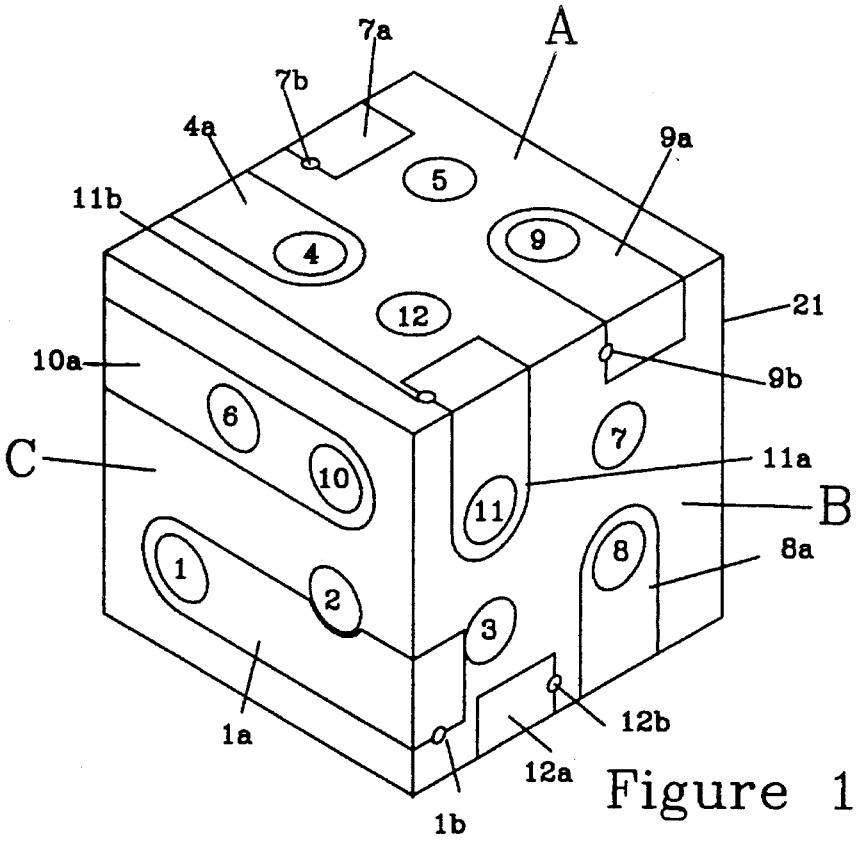
FIG. 1 shows three faces of the puzzle toy.
Figure 2:
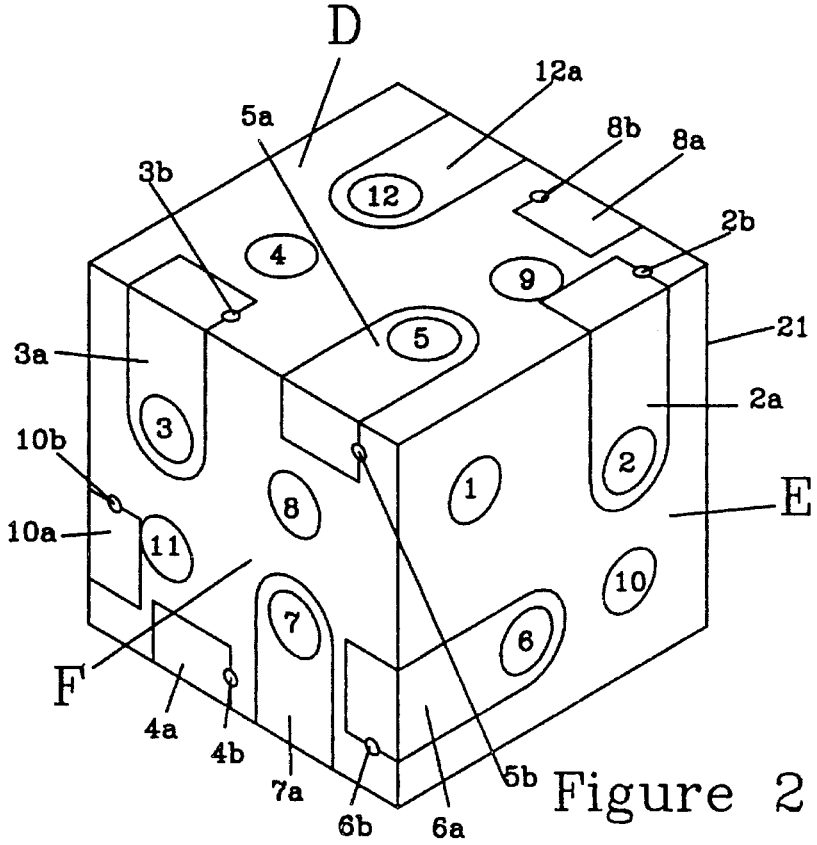
FIG. 2 shows the three faces opposite the three faces of FIG. 1.

The invention is to a block toy, shown in FIG. 1 and 2, in which a solid block 21 has a plurality of holes bored completely through the faces A, B, C, D, E and F of block 21. In each hole is a pin 1–12 which extends complete through the hole and exposes the end of each pin on opposite faces of block 21. Pins 1–11 have cut-out portions allowing one or more pins to extend partially through the pin. Some of the holes through which pins 1–12 extend, intersect transverse holes from adjacent faces of block 21.

FIG. 1 shows faces A, B and C of block 21. Face A includes holes through which pins 4, 5, 9 and 12 extend. The other ends of pins 4, 5, 9 and 12 extend to Face D, as illustrated in FIG. 2. Each pin has a slide associated with one end. Pin 9 has a slide **9*a* and a track 9*b* on which slide 9*a* slides in and out of block 21. Pin 4 also has a slide 4*a*. Pins 5 and 12 have slides 5*a* and 12*a* and tracks 5*b* and 12*b* respectively. Slide 5 has a track 5*b* in Face F, and slide 12*a* has a track 12*b*** in face B.

Exposed at face B are the ends of pins 3, 7, 8 and 11. Slides **8*a* and 11*a* are in face B. Also shown are track 9*b* for slide 9*a* track 11*b* for slide 11*a*, track 7*b* for slide 7*a*, track 1*b* for slide 1*a*, and track 12*b* for slide 12*a*. Face C shows pins 1, 2, 6 and 10. Slides 1*a* and 10*a*** are in face C.

FIG. 2 shows the three sides of block 21 opposite the faces A, B and C shown in FIG. 1. Face D is opposite face A, Face E is opposite face C, and Face F is opposite face B. Face D includes slides **5*a* and 12*a*, and exposed the ends of tracks 2*b*, 3*b* and 8*b*. Face E includes slides 2*a* and 6*a*. Face F includes slides 3*a* and 7*a*, and slide tracks 4*b*, 5*b*, 6*b* and 10*b***.

Figure 4:
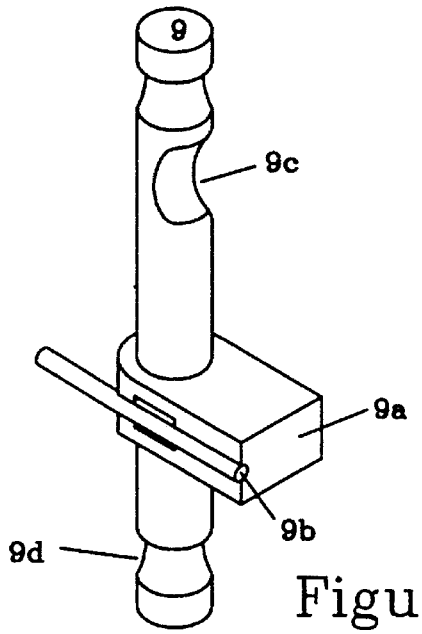
FIG. 4 shows the structure of the slide and pin.
Figure 3:
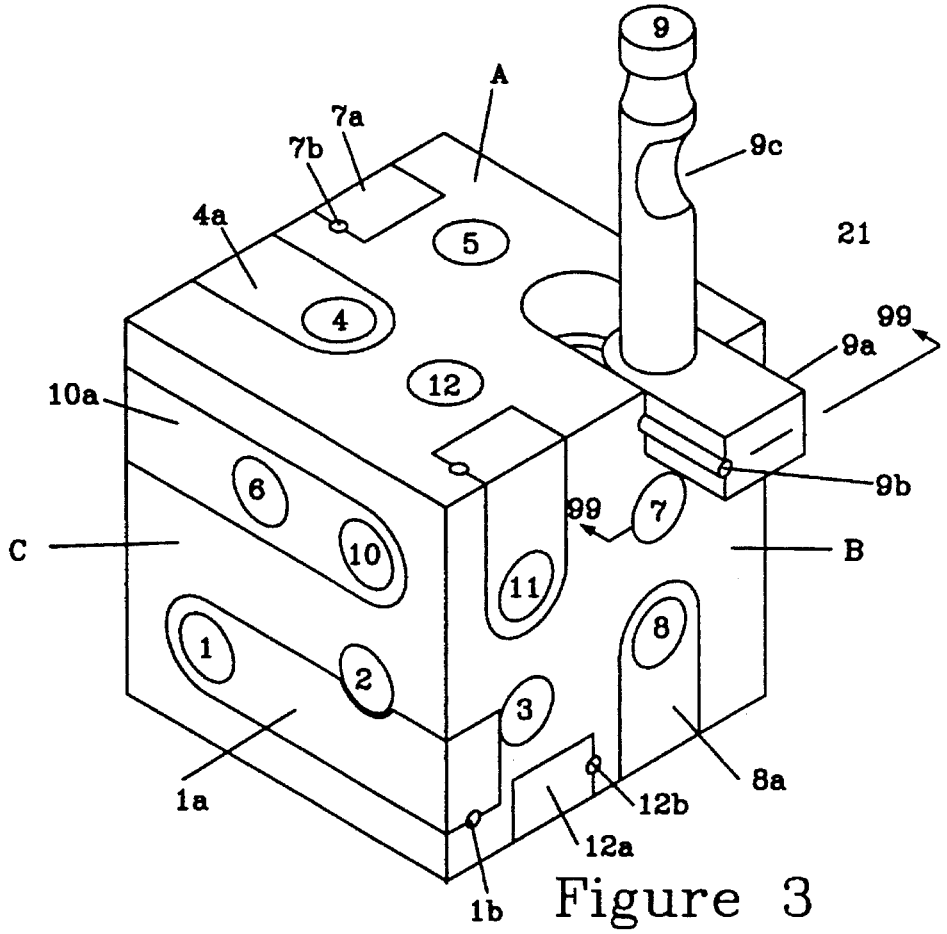
FIG. 3 shows the puzzle toy with a pin and slide.

FIG. 3 is the same as FIG. 1 with slide **9*a* in an extend position. When pin 9 is pulled out of block 21, and clears the hole it is in, then slide 9*a* is pushed out of its position in block 21 by a spring 9*e* (shown in FIG. 9). FIG. 4 illustrates pin 9, slide 9*a* and track 9*b*. Track 9*b* guides slide 9*a* in and out of position in block 21. Track 9*b* is attached to 9*a* so that slide 9*a* and track 9*b* slide in and out of block 21. Pin 9 has a notch 9*c* extending half way through pin 9. Notch 9*c* allows another pin to pass partially through pin 9**.

Figure 5:
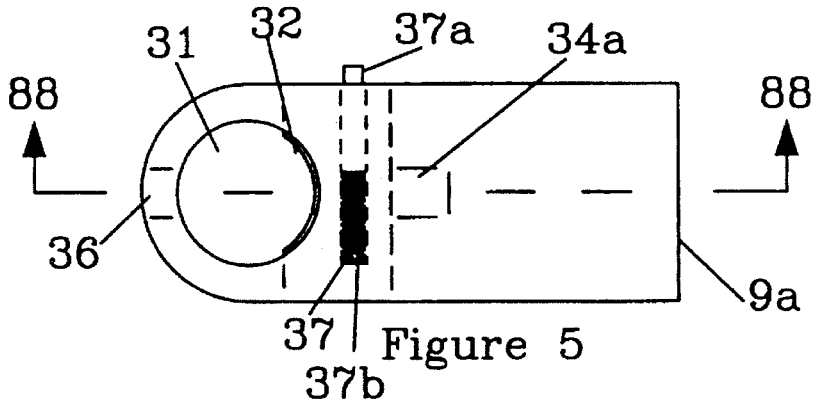
FIG. 5 is a top view of the slide.
Figure 7:
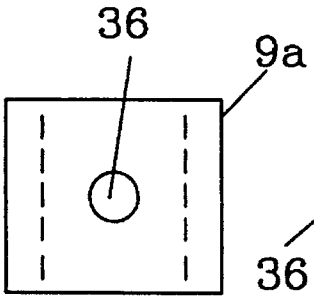
FIG. 7 is an end view of the slide.
Figure 6:
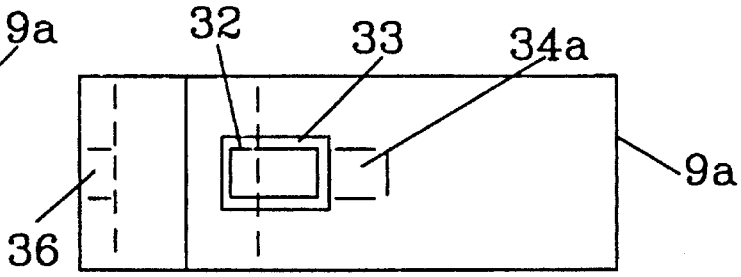
FIG. 6 is a side view of the slide.

FIG. 5, 6 and 7 are top, side and end views, respectively, of slide **9*a*. The other slides have basically the same structure, except that some slides are of different length from other slides. FIG. 5 is a top view showing slide 9*a* with opening 31 through which pin 9 is placed. Pin 9 is held in slide 9*a* by retaining arm 32 which is held in an extend position by spring 34 in opening 34*a*. Arm 32 moves into notch 9*d* (FIG. 4) of pin 9 as it is pulled out of block 21. Arm 32 prevents pin 9 from being removed from slide 9*a* as pin 9 is pull out of block 21. Arm 32 is inserted into slide 9*a* through an opening 33 in the side of slide 9*a* (FIG. 6) Spring 34 is inserted into slide 9*a* through opening 36, is depressed, and then arm 32 is inserted. Retainer pin 37*a*, in opening 37 is held in an extended position by spring 37*b*. The purpose of pin 37*a* is explained below with reference to FIG. 9**.

Figure 8:
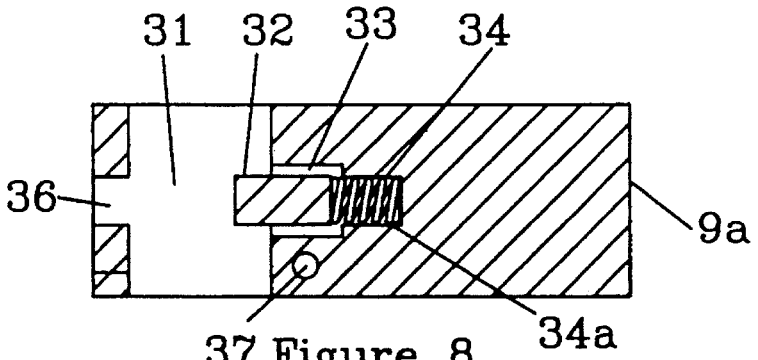
FIG. 8 is a cross-sectional view of the slide.

FIG. 8 is a cross-section view of slide 9*a*, taken through section 88—88 in FIG. 5. Spring 34 is shown biasing arm 32 in an outward position. Opening 37 is shown below opening 33 so that pin 37*a* and spring 37*b* will not interfere with spring 34 and arm 32.

Figure 9:
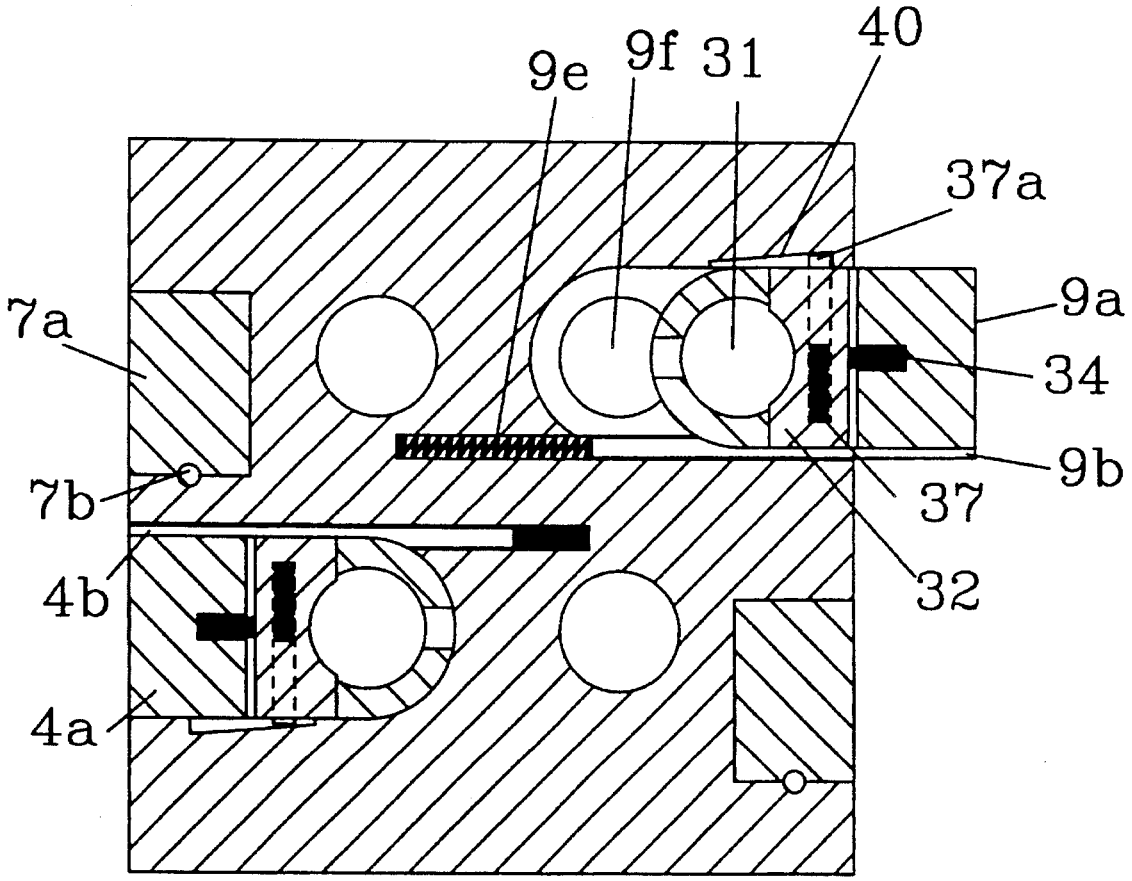
FIG. 9 is a cross-sectional view of the block showing the slide mounting area in the solid block.
Figure 10:
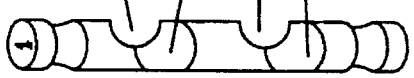
FIGS. 10–21 show the pins and the cut-out portions of each pin.
Figure 11:
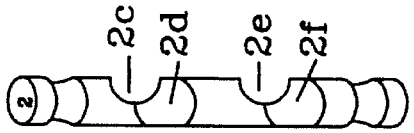
Figure 12:
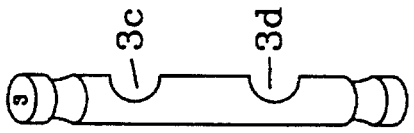
Figure 13:
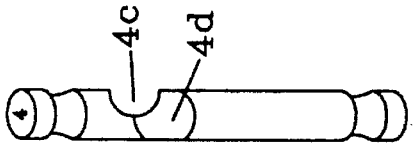
Figure 14:
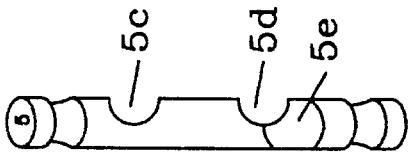
Figure 15:
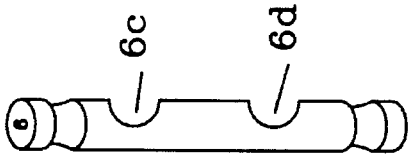
Figure 16:
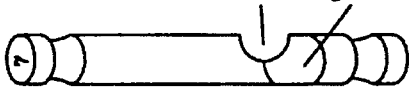
Figure 17:
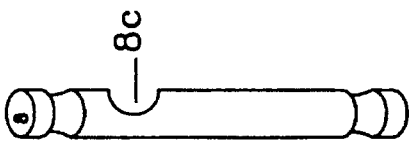
Figure 18:
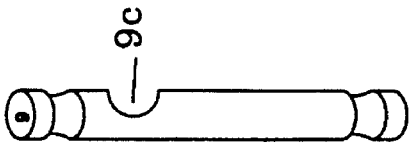
Figure 19:
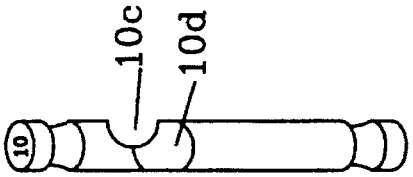
Figure 20:
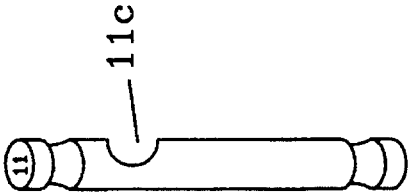
Figure 21:
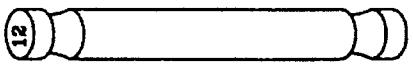

FIG. 9 is a cross-sectional view of block 21 taken through section 99—99 of FIG. 3. Slide 4*a* is shown in position in block 21 and slide 9*a* is shown in an extended position. When the end pin (not illustrated) clears the opening 9*f* of the hole in block 21, spring 9*e* pushes on track 9*b*, pushing slide 9*a* out of its position in block 21. Slide 9*a* will not be pushed completely out of block 21 because pin 37*a* is in slot 40 which stops slide 9*a* after the end of pin 9 (not illustrated) in hole 31 clears opening 9*f*.

FIGS. 10–21 show the twelve pins used in the block puzzle and the notches in each pin. The notches allow other pins to partially pass through the pin as it is inserted into block 21. Pin 1 has four notches, 1*c*, 1*d*, 1*e* and 1*f*. Notches 1*c* and 1*d* are at right angles to each other and notches 1*e* and 1*f* are at right angles to each other.

Pin 2 also has four notches and are positioned the same as the notches in pin 1. Pins 3, 4, 6, 7 and 10 each have two notches. Pin 3 has notches 3*c* and 3*d* and pin 6 has notches 6*c* and 6*d* cut in the same side. Pin 4 has notches 4*c* and 4*d* and pin 7 has notches 7*c* and 7*d* cut at right angles to each, but on opposite ends of the pins. Pin 10 is the same as pin 4.

Pin 5 has three notches 5*c*, 5*d* and 5*e* where 5*c* and 5*d* are on the same side, and notch 5*e* is at a right angle to notch 5*d*.

Pins 8, 9 and 11 each have a single notch, and pin 12 does not has a notch.

The number of notches in a pin depends upon its position in block 21 and its order of insertion into block 21. While each pin has been given a number which designates the order in which it is inserted in block 21, the pins in the block puzzle would not be numbered. As numbered, pin 1 is first inserted into block 21, followed by the pins 2–12 in sequential numerical order. The pins are then removed from block 21 in reverse order, i.e. starting with pin 12. Since pin 12 is the last to be inserted, there is no notch in pin 12. As a pin is inserted into block 21, it may have to be rotated to ensure the notch or notches in the pin align with the bore holes thorough which it passes. This will allow subsequent pins to be inserted through its respective bore hole.

Figure 22:
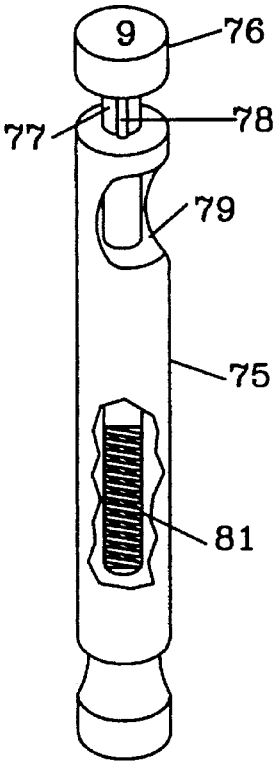
FIGS. 22–24 are the structural details of a second embodiment of a pin.
Figure 23:
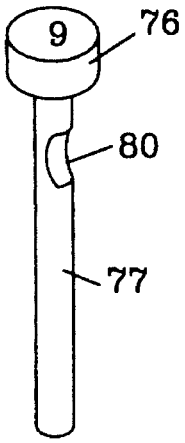
Figure 24:
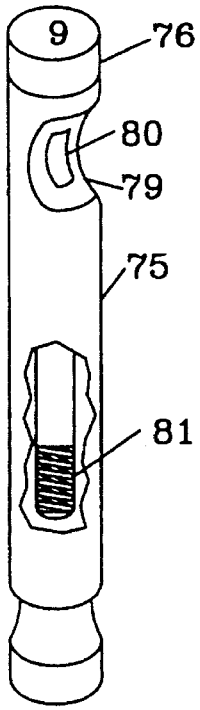

FIGS. 22–24 illustrate a second embodiment of a pin used in the block puzzle. In a pin of the first embodiment, to remove a pin from its bore hole, the end of the pin has to be pushed inward with the finger to allow the pin to be grasped at the other end to remove it out of the block. In the embodiment illustrated in FIG. 22–24, as soon as all pins partially extending through a pin have been removed, an end 76 of the pin pops-up allowing the pin to be pulled out of the block without having to push the pin from the opposite end. The pin has a main body 75 with a secondary pin 77 and guide 78 extending down in to body 75. Secondary pin 77 has an end 76 for grasping when pulling pin 75 out of a bore hole in the block. Pin 77 is spring biased in an upward position by spring 81. Both pin 75 and pin 77 have at least one notch, notch 79 in pin 75 and notch 80 in pin 77. When pin 77 is pressed down into pin 75 notches 79 and 80 align with each other so that another pin can pass though notches 79 and 80. The pin passing through notches 79 and 80 hold pin 77 downward compressing spring 81. As soon as the pin is withdrawn from within notches 79 and 80 pin 77 will pop-up. Each pin will have as many notches as there are notches for the position of the pin. For example, if the pin is pin 1 in sequence, then there will be four sets of notches as shown in pin 1 of FIG. 10.

The object of the puzzle is to be able to pull all of the pins in an outward extended position, or move all of the pins into the block. Since the pins are not numbered, then the insertion and removal of all the pins in the exact order will comprise the puzzle.

What is claimed:

1. A block and pin puzzle, comprising:

a block having a plurality of holes, each hole extending between two surfaces of the block;

a plurality of pins for inserting into said holes; and a slide associated with each pin for moving the pin between two positions, a first position when the pin is to be inserted into its respective hole, and a second position when a pin is removed from its respective hole.

2. The puzzle according to claim 1, wherein selected ones of said pins have at least one notch cut partially through the pin.

3. The puzzle according to claim 1, wherein each slide moves into and out of a slot in a surface of said block.

4. The puzzle according to claim 3, wherein each slide moves on a track into and out of said slot.

5. The puzzle according to claim 3, wherein each slide has a retaining pin to prevent the slide from being completely removed from its slot.

6. The puzzle according to claim 1, wherein each slide includes a retaining arm which prevents the pin from being completely removed from the slide.

7. The puzzle according to claim 1, wherein each pin has a spring biased end which moves upward when the pin is to be removed from its hole in the block.

8. The puzzle according to claim 7, wherein said spring biased end includes a shaft extending in to the pin, and said shaft is partially removed to correspond to any notch in the pin.

9. The puzzle according to claim 1, wherein at least one pin has at least one notch through which another pin must pass as it is inserted through the block.

10. A block and pin puzzle, comprising:

a block having a plurality of surfaces and a plurality of holes, each hole extending between two surfaces of the block;

a plurality of notched pins for inserting into or removing from said holes in a fixed sequence; and a slide associated with each pin for moving the pin between two positions, a first position when the pin is to be inserted into its respective hole, and a second position when a pin is removed from its respective hole.

11. The puzzle according to claim 10, wherein each slide moves into and out of a slot in a surface of said block.

12. The puzzle according to claim 11, wherein each slide moves on a track into and out of said slot.

13. The puzzle according to claim 12, wherein each slide has a retaining pin to prevent the slide from being completely removed from its slot.

14. The puzzle according to claim 10, wherein each slide includes a retaining arm which prevents the pin from being completely removed from the slide.

15. The puzzle according to claim 10, wherein each pin has a spring biased end which moves upward when the pin is to be removed from its hole in the block.

16. The puzzle according to claim 15, wherein said spring biased end includes a shaft extending in to the pin, and said shaft is partially removed to correspond to any notch in the pin.

17. The puzzle according to claim 10 wherein at least one pin has at least one notch through which another pin must pass as it is inserted through the block.

* * * * *